US005899049A

United States Patent [19]

Fuss et al.

[11] Patent Number: 5,899,049

[45] **Date of Patent: *May 4, 1999**

[54] SYSTEM AND METHOD FOR MAKING CUSHIONS OF LOOSE FILL PACKING MATERIAL

[75] Inventors: Gunter G. Fuss, San Mateo; Vladimir Yampolsky, San Carlos; Ronald N. Clazie, Menlo Park, all of Calif.

[73] Assignee: Free-Flow Packaging International, Inc., Redwood City, Calif.

[ * ] Notice: This patent is subject to a terminal disclaimer.

[21] Appl. No.: 08/882,626

[22] Filed: Jun. 25, 1997

Related U.S. Application Data

[63] Continuation-in-part of application No. 08/843,914, Apr. 17, 1997, Pat. No. 5,782,061, which is a continuation-in-part of application No. 08/766,156, Dec. 12, 1996, Pat. No. 5,778,642, which is a continuation-in-part of application No. 08/673,296, Jun. 28, 1996, Pat. No. 5,826,404.

[51] Int. Cl.[6] ..... B56B 43/26

[52] U.S. Cl. ..... 53/459; 53/576; 53/390; 53/261; 53/262; 53/469

[58] Field of Search ..... 53/576, 567, 390, 53/575, 577, 459, 469, 261, 262; 141/313; 452/37, 39, 32

[56] References Cited

U.S. PATENT DOCUMENTS

| | | | |
|---|---|---|---|
| 2,656,658 | 10/1953 | Grady | 53/567 |
| 3,281,089 | 10/1966 | Krueger et al. . | |
| 3,938,300 | 2/1976 | Lovqvist | 53/124 |
| 3,983,914 | 10/1976 | Benson | 141/390 |
| 4,037,778 | 7/1977 | Boyle | 229/55 |
| 4,446,677 | 5/1984 | Kokido | 53/577 |
| 4,467,499 | 8/1984 | Beckman | 17/49 |
| 4,493,179 | 1/1985 | Brak | 53/576 |
| 4,790,124 | 12/1988 | Kaji | 53/552 |
| 4,890,652 | 1/1990 | Hoerner | 141/10 |
| 4,945,715 | 8/1990 | Brodrecht | 53/567 |
| 5,009,058 | 4/1991 | Ptaschek | 53/469 |
| 5,465,559 | 11/1995 | Heiner | 53/567 |
| 5,469,693 | 11/1995 | Brodrecht | 53/567 |

FOREIGN PATENT DOCUMENTS

| | | |
|---|---|---|
| 456144A1 | 11/1991 | European Pat. Off. . |
| 1196228 | 5/1961 | France . |
| 93147317 | 2/1994 | Germany . |
| 1564397 | 4/1980 | United Kingdom . |
| WO9406687 | 3/1994 | WIPO . |

*Primary Examiner*—Daniel B. Moon
*Assistant Examiner*—James P. Calve
*Attorney, Agent, or Firm*—Flehr Hohbach Test Albritton & Herbert

[57] ABSTRACT

System and method for packing loose fill materials in bags to form cushions for use in protecting articles in shipping cartons. The bags are produced from a length of flexible plastic tubing which is gathered or bunched to form a coil which is disposed about the outlet of a loose fill dispenser. A section of the tubing is pulled from the coil, and its lower end is closed to form a bag which is then filled with loose fill material dispensed through the outlet. Another section of tubing is then pulled from the coil, and the tubing is drawn together to close the upper end of the first section and the lower end of the second section. The closed ends are secured with tape, and the tubing is severed to separate the first section from the second. The cushions thus formed are placed in the shipping cartons with the articles, and in some embodiments are compressed and reexpanded in conformance with the contour of the articles.

20 Claims, 12 Drawing Sheets

SYSTEM AND METHOD FOR MAKING CUSHIONS OF LOOSE FILL PACKING MATERIAL

This is a continuation-in-part of Ser. No. 08/843,914, filed Apr. 17 1997, U.S. Pat. No. 5,782,061 which is a continuation-in-part of Ser. No. 08/766,156, filed Dec. 12, 1996, U.S. Pat. No. 5,778,642 which is a continuation-in-part of Ser. No. 08/673,296, filed Jun. 28, 1996 U.S. Pat. No. 5,826,404. This application is also related to the subject matter of Ser. No. 08/816,114, filed Mar. 11, 1997 U.S. Pat. No. 5,782,067.

This invention pertains generally to loose fill packing materials and, more particularly, to a system and method for packaging loose fill packing materials in bags for use as cushions in shipping cartons.

Loose fill packing materials are widely used in the protective packing of articles for shipment. They are commonly poured into a carton so as to surround and embrace the articles and thereby cushion them during shipment.

Loose fill materials are fabricated of a variety of materials such as foamed plastics and, more recently, starch and other biodegradable materials.

One problem with loose fill materials is that they tend to spill both during packaging and also when the cartons are opened and the articles packed in them are removed. Being light in weight, the materials also have a tendency to fly about, and some of them exhibit a static cling which makes them particularly difficult to deal with.

It is in general an object of the invention to provide a new and improved system and method for utilizing loose fill packing materials.

Another object of the invention is to provide a system and method of the above character which eliminates the messiness, spillage and static cling which occur when articles are packed in loose fill materials.

These and other objects are achieved in accordance with the invention by packing loose fill materials in bags to form cushions for use in protecting articles in shipping cartons. The bags are produced from a length of flexible plastic tubing which is folded and gathered to form a coil which is disposed about the outlet of a loose fill dispenser. A section of the tubing is pulled from the coil, and its lower end is closed to form a bag which is then filled with loose fill material dispensed through the outlet. Another section of tubing is then pulled from the coil, and the tubing is drawn together to close the upper end of the first section and the lower end of the second section. The closed ends are secured with tape, and the tubing is severed to separate the first section from the second. The cushions thus formed are placed in the shipping cartons with the articles, and in some embodiments are compressed and reexpanded in conformance with the contour of the articles.

Figure 8:
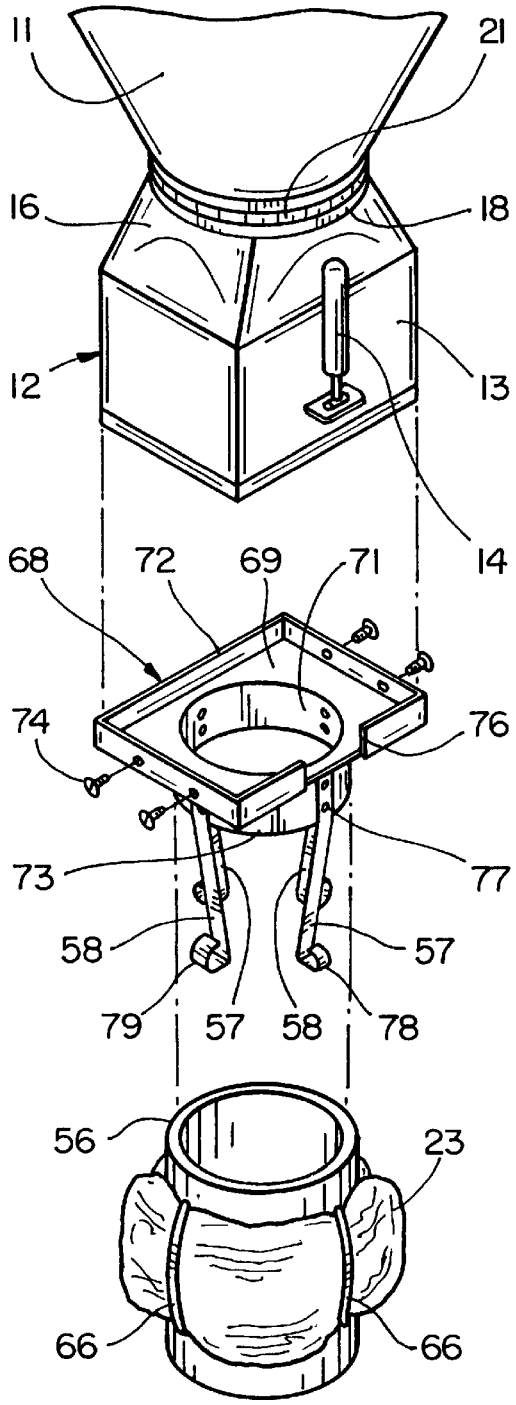
FIG. 8 is a fragmentary exploded isometric view of another embodiment of a system for bagging loose fill packing material in accordance with the invention.

FIGS. 12*a*–12*g* are operational views of the embodiment of FIG. 8.

Figure 13:
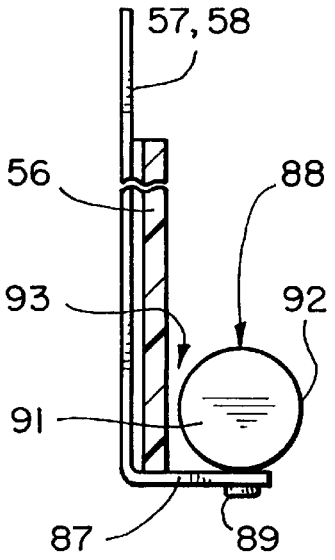
Figure 14:
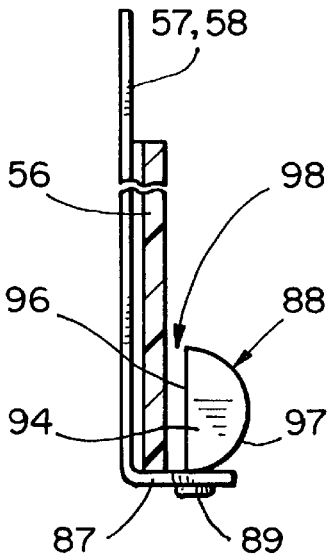

FIGS. 13 and 14 are side elevational views of additional embodiments of tubing holders for use in the embodiment of FIG. 8.

Figure 15:
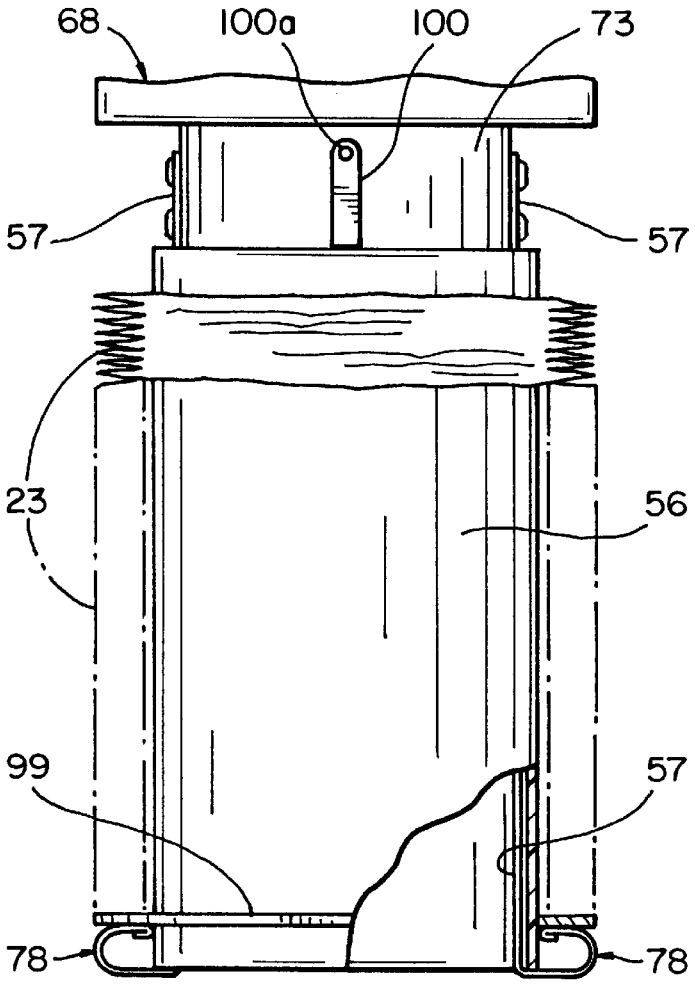

FIG. 15 is a side elevational view, partly broken away, of another embodiment of a system for bagging loose fill packing material in accordance with the invention.

Figure 16:
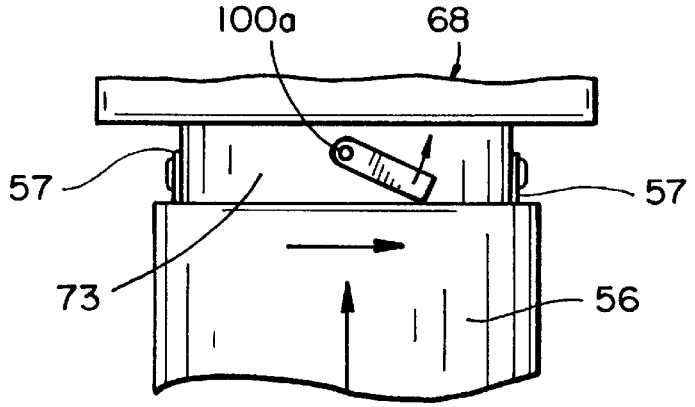

FIG. 16 is an operational view of the embodiment of FIG. 15.

Figure 17:
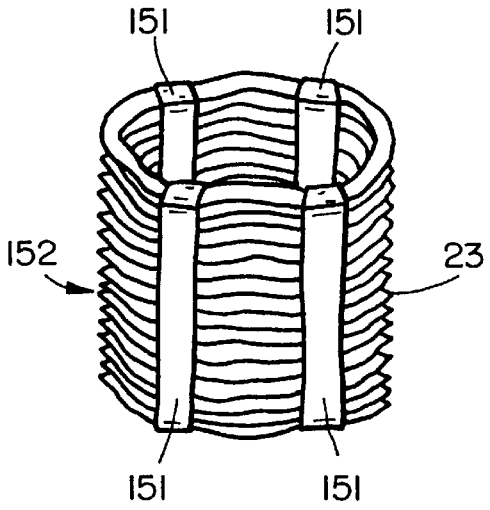

FIG. 17 is an isometric view of one embodiment of a bundle of tubing for use in a system incorporating the invention.

Figure 18:
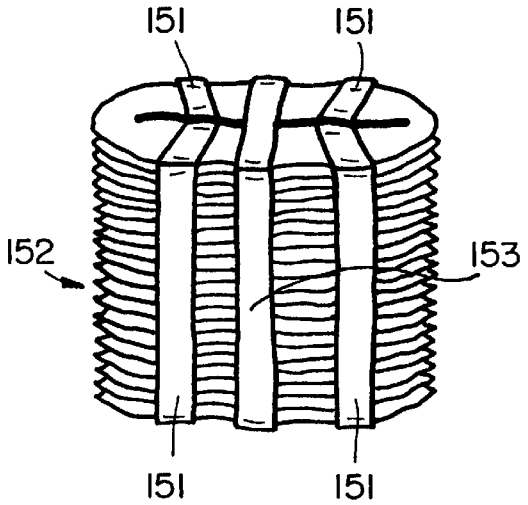

FIG. 18 is an isometric view of the bundle of FIG. 17 in a flattened or compressed state.

Figure 19:
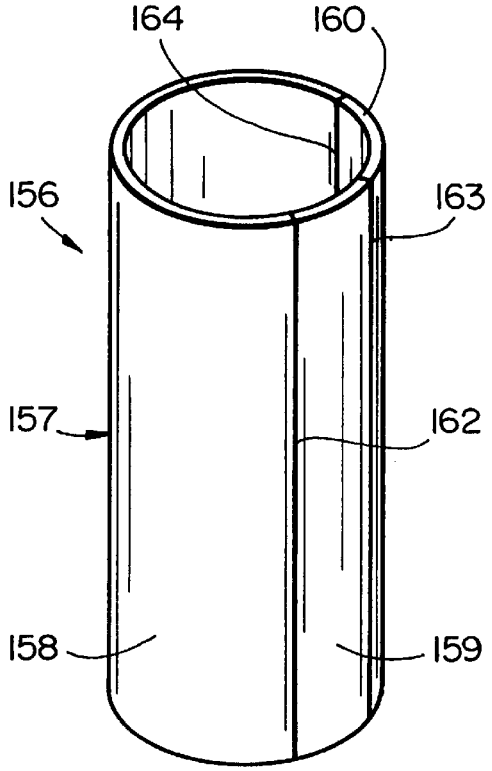

FIG. 19 is an isometric view of one embodiment of a collapsible core for use with the bundle of FIG. 17.

Figure 20:
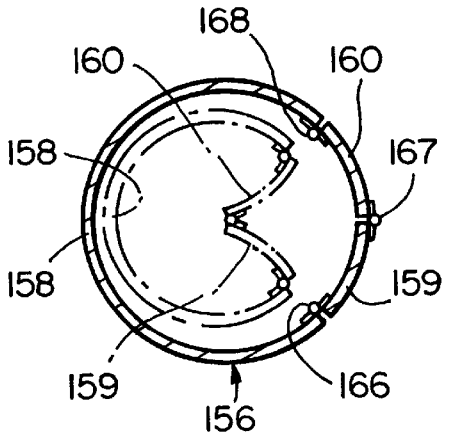

FIG. 20 is a cross-sectional view of the embodiment of FIG. 19.

Figure 21:
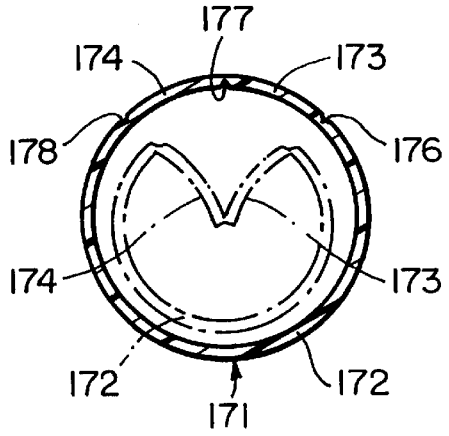

FIG. 21 is a cross-sectional view of another embodiment of a collapsible core according to the invention.

Figure 22:
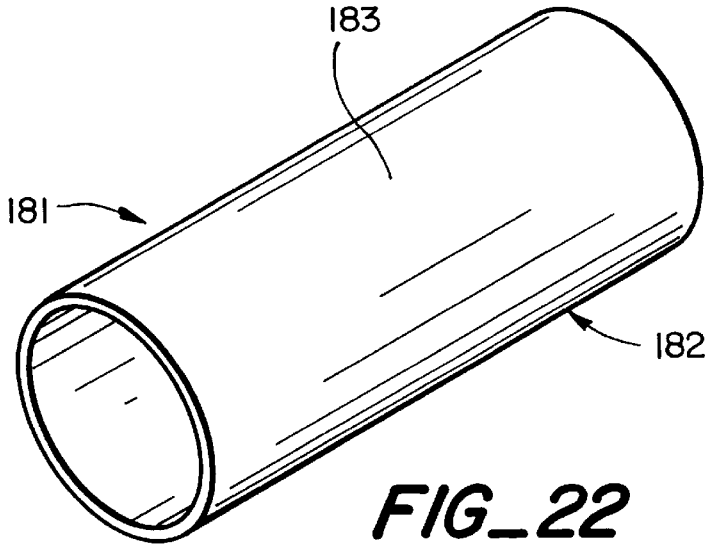

FIG. 22 is an isometric view of another embodiment of a collapsible core according to the invention.

Figure 23:
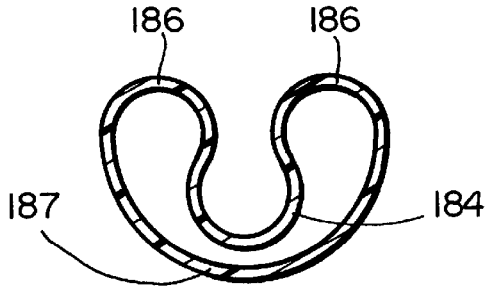

FIG. 23 is a cross-sectional view of the embodiment of FIG. 22 showing the cylinder in its collapsed state.

Figure 24:
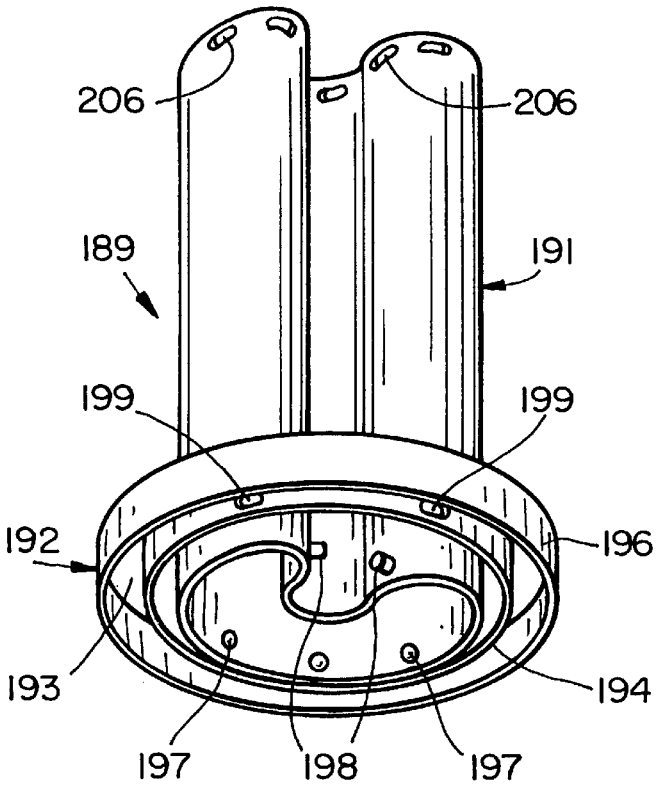

FIG. 24 is an isometric view of another embodiment of a collapsible core according to the invention.

Figure 25:
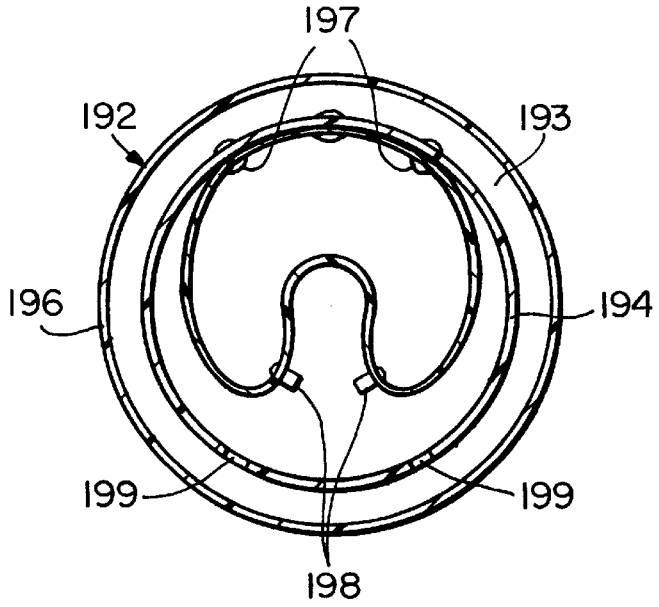

FIG. 25 is a cross-sectional view of the embodiment of FIG. 24.

Figure 26:
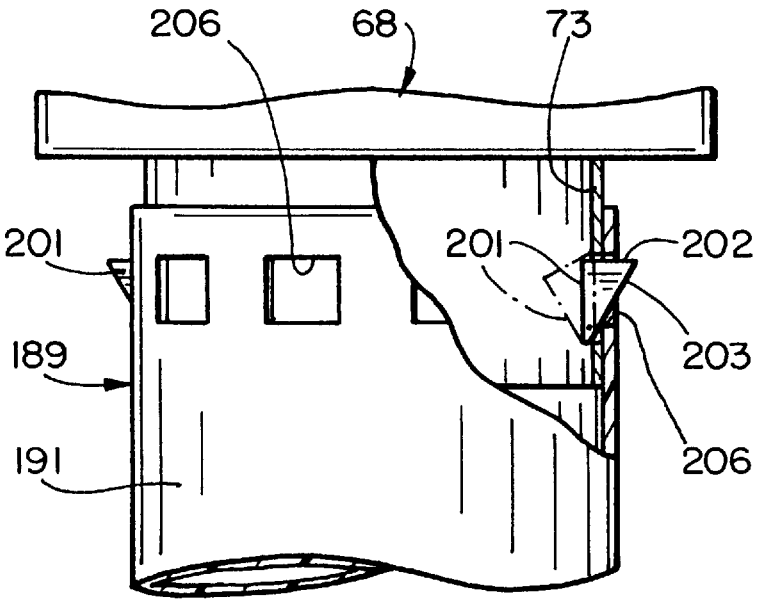

FIG. 26 is a fragmentary side elevational view, party broken away, of an embodiment of a system for dispensing loose fill packing material with the collapsible core of FIG. 24.

Figure 27:
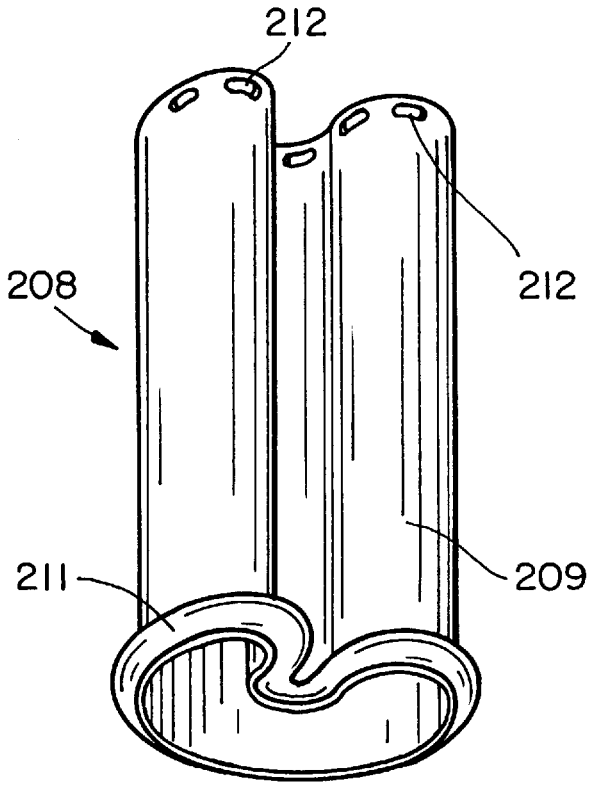

FIG. 27 is an isometric view of another embodiment of a collapsible core according to the invention.

Figure 1:
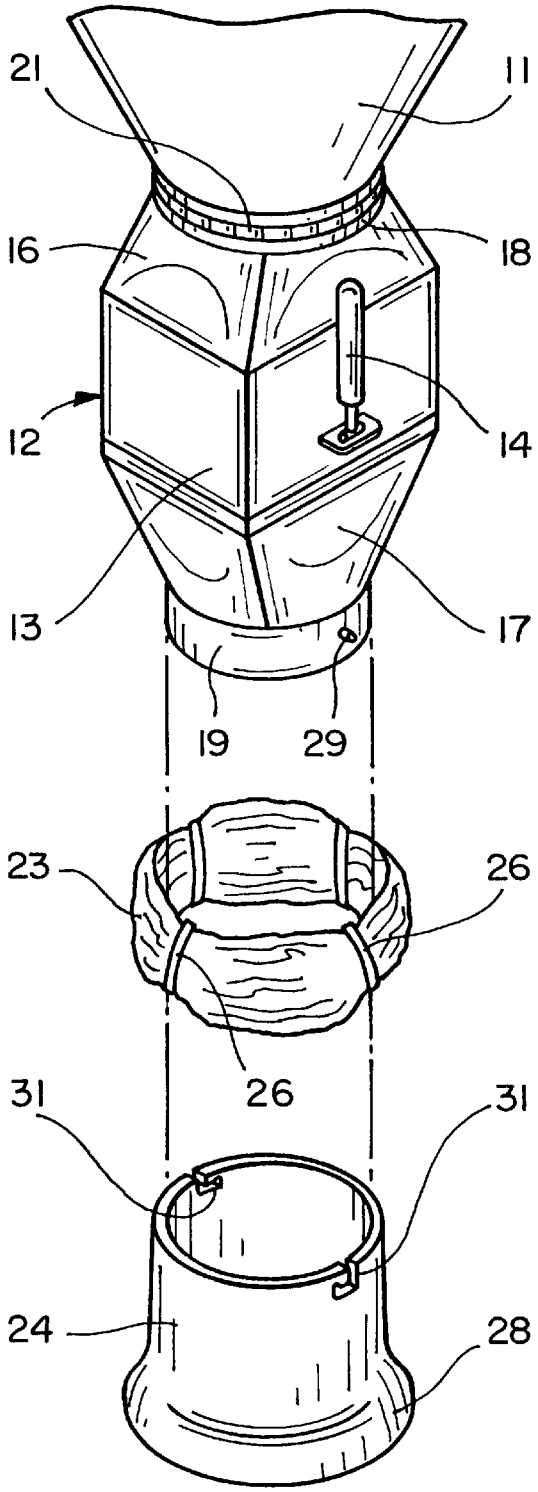
FIG. 1 is a fragmentary, partly exploded isometric view of one embodiment of a system for bagging loose fill packing material in accordance with the invention.

As illustrated in FIG. 1, the system includes a hopper 11 for holding a supply of loose fill packing material, with a valve 12 at the lower end of the hopper for dispensing the material from the hopper. The valve can, for example, be of the type disclosed in U.S. Pat. No. 4,844,291, the disclosure of which is incorporated herein by reference. It has a generally rectangular body 13 with a pair of hinged flaps (not shown) connected to an operator 14 for controlling the flow of material through the valve. The valve has transition pieces 16, 17 on its inlet and outlet sides, with circular collars 18, 19 at the outer ends thereof.

Hopper 11 comprises a tapered bag fabricated of a flexible plastic material such as polyethylene which is suspended from the ceiling or other suitable support. The upper end of the hopper bag is open, and the lower end is secured to the circular collar on the upper, or inlet, side of the valve by a band clamp 21.

On the outlet side of the valve, a length of flexible plastic tubing 23 is stored on a coil holder 24 mounted on collar 19 for use in the formation of bags for holding loose fill material dispensed through the valve. The tubing is folded and gathered in an axial direction to form a coil which is held together by suitable means such as paper tape or ties 26 until it is mounted on the coil holder. The tubing can be fabricated of any suitable material such as polyethylene, and can be of any desired weight. A polyethylene tubing having a wall thickness of 0.5 mil has been found to provide good strength and flexibility for the bags, and with a 0.5 mil material, a coil can contain several hundred feet of tubing. Other suitable materials include high density polyethylene, low density polyethylene, netting, and cellulose (paper) products.

The tubing is provided with vent holes 27 which serve to prevent air from being trapped within the tubing as the side walls are drawn together to form the cushions. The holes can be of any suitable size and spacing, and in one presently preferred embodiment, they are on the order of ½ inch in diameter and spaced on centers about 3–5 inches apart.

The lower end 28 of the coil holder is enlarged to retain the coil on the coil holder. The tubing is withdrawn from the coil holder by pulling it down over the enlarged end, with the outer diameter of the enlarged end being slightly larger than the unstarched tubing so that the tubing will remain in place unless it is pulled. In the embodiment illustrated, the enlarged end is shown as a flare. However, it can be formed in any other suitable manner such as by slotting the end portion of the cylindrical side wall and bending the tabs thus formed between the slots in an outward direction or by attaching a plurality of outwardly projecting tabs to the side wall.

The coil holder is removably mounted on outlet collar 19 by means of a bayonet mount comprising a pair of pins 29 which extend radially from the collar and are received in J-shaped slots 31 in the upper end of the cylindrical side wall of the coil holder.

Figure 4:
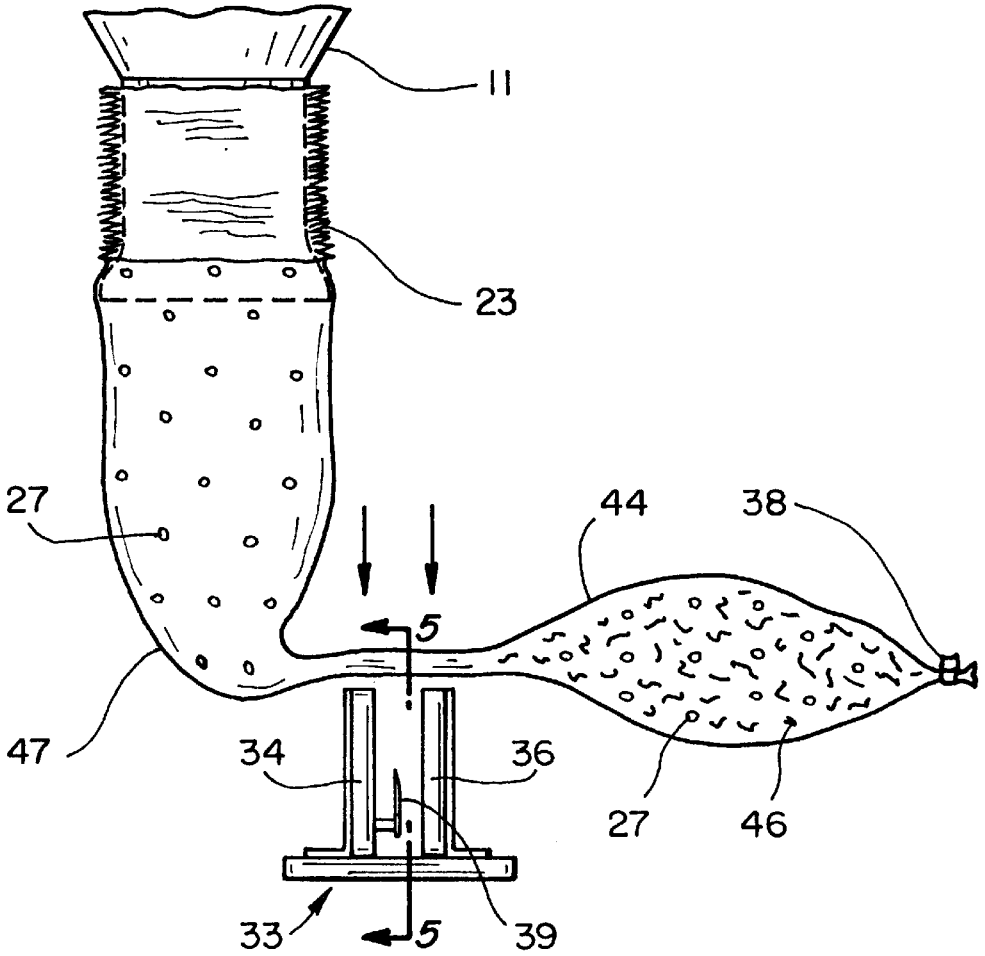
FIG. 4 is a view similar to FIG. 3, illustrating the closing and cutting of successive bags of loose fill material.
Figure 5:
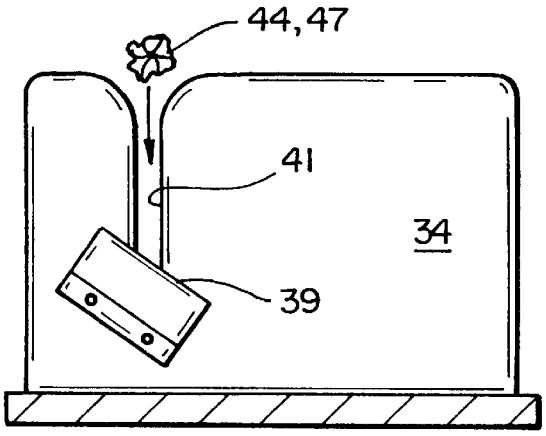
FIG. 5 is a cross-sectional view taken along line 5—5 in FIG. 4.

As illustrated in FIGS. 4–5, the system also includes a tool 33 for cutting the tubing into bag-length sections and the closing bags thus formed. This tool includes a pair of tape dispensers 34, 36 which apply bands of tape 37, 38 to the tubing after it has been drawn together, and a cutting blade or knife 39 which cuts the two sections of tubing apart between the bands of tape. Suitable tape dispensers are available commercially, and include the Jokari Model 05505 bag sealer and the Excell® EG Cut Bag Sealer, Model No. 605K.

Each of the tape dispensers has a vertically extending guide slot 41 through which the gathered walls of the tubing are drawn to trigger the application of the tape. The blade is positioned toward the lower ends of the guide slots and inclined at an angle of about 45° to the slots for slicing the tubing material immediately after it passes the point where the tape is applied.

The taping and cutting tool is positioned below and to one side of the outlet of the dispenser, within reach of the lower end of a bag which is still hanging from the coil holder. The tool can be mounted on a stand or other suitable support.

An improved and currently preferred tool for applying the tape and severing the sections of tubing is described in Ser. No. 08/816,114, filed Mar. 11, 1997, the disclosure of which is incorporated herein by reference.

If desired, the closed ends of the tubing sections or bags can be secured with means other than tape strips. Other suitable means include metal clips, heat sealing, wire ties, plastic ties, string, and the like.

The loose fill material can be any material which is suitable for use in the cushions. Suitable materials include, but are not limited to, polystyrene, starch-based materials, paper and popcorn. It is also possible to use brittle and flaky materials which ordinarily are not suitable for use as packing materials. It is also possible to use combinations of different materials, and since they are enclosed within the bags, they will not be unsightly.

Operation and use of the system, and therein the method of the invention, are as follows. Loose fill material is introduced into the hopper from above by suitable means such as a pneumatic conveyor (not shown) or by lowering the hopper bag and pouring the material into it. Coil holder 24 is removed from the dispenser, and a coil of tubing 23 is placed on it. The coil holder is reattached to outlet collar 19, and the ties 26 which hold the coil together are removed.

Figure 3:
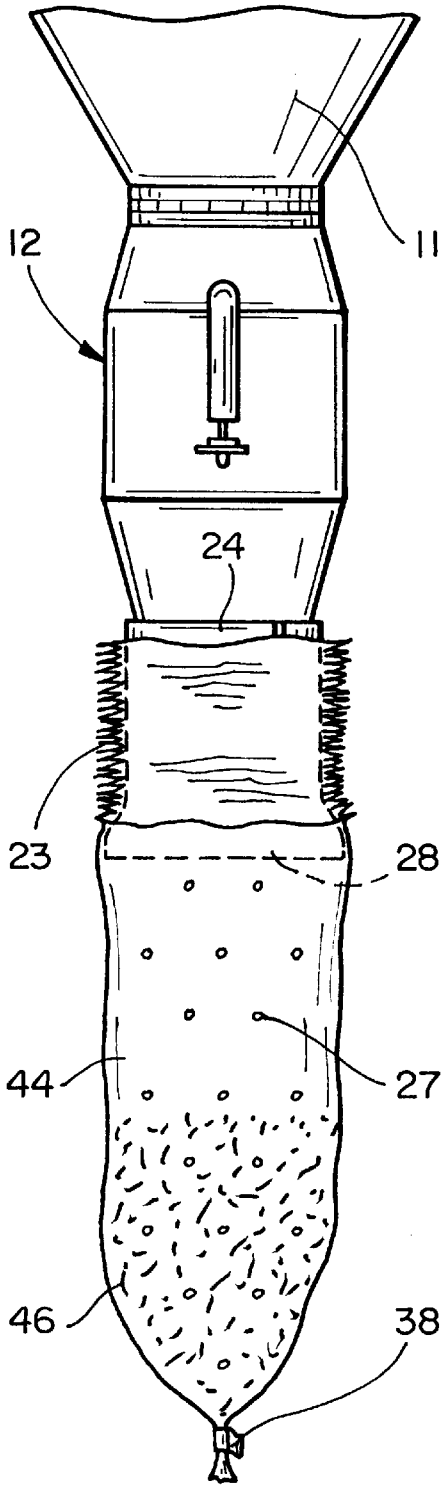
FIG. 3 is a front elevational view of the embodiment of FIG. 1, illustrating the formation and filling of a bag with loose fill material.
Figure 2:
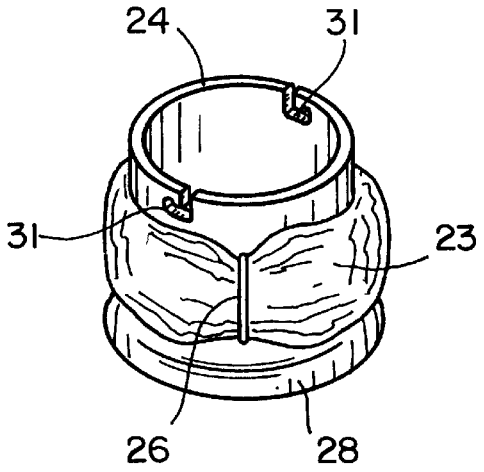
FIG. 2 is an isometric view of the coil holder with tubing from which bags are formed in the embodiment of FIG. 1.

A first section of tubing 44 is withdrawn from the coil by pulling it down over the enlarged lower end 28 of the coil holder, and the lower end of that section is drawn together and taped to form a bag which hangs from the dispenser, as illustrated in FIG. 3. The valve is then opened to discharge a predetermined amount of the loose fill material 46 into the bag.

After the bag has been filled to the desired level, a second section of tubing 47 is withdrawn from the coil, and the portion of the tubing between the two sections is drawn together and passed through taping and cutting tool 33. As the material is pressed into the tool and passes in a downward direction through the guide slots 41, bands of tape 37, 38 are applied simultaneously to the upper end of section 44 end to the lower and of section 47 to secure those ends in the closed position. The downward motion of the tubing then brings it into contact with blade 39 which severs the tubing between the two bands of tape, thereby separating the filled bag or cushion 49 formed by section 44 from section 47.

This process is repeated to form additional bags or cushions from successive sections of the tubing. In many applications, it has found to be desirable to fill the bags only about half full. That permits the objects being packed to nestle into the cushions, with the material in the cushions encompassing the objects to better protect them.

Figure 6:
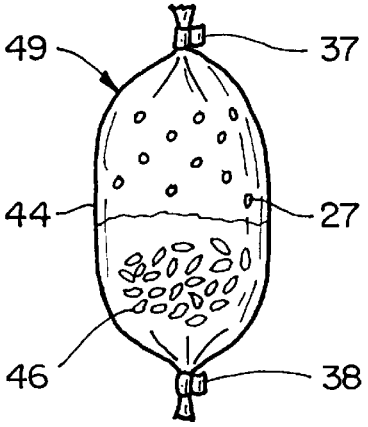
FIG. 6 is an isometric view of a bag filled with loose fill packing material in accordance with the invention.

A finished cushion is illustrated in FIG. 6. As discussed more fully hereinafter, it is used by placing it and other cushions like it about an article in a carton. With the loose fill material enclosed in the cushion, there is no spillage of material during the packaging process.

When the carton is opened and the articles inside it are removed, there is no spillage or other mess with loose fill materials, and there is no need to dig for the articles in the material. The cushions are simply removed from the carton as needed to provide access to the articles. The cushions remain in tact, with the loose fill material fully contained within them, and they can be recycled, reused, or disposed of, as desired.

Figure 7:
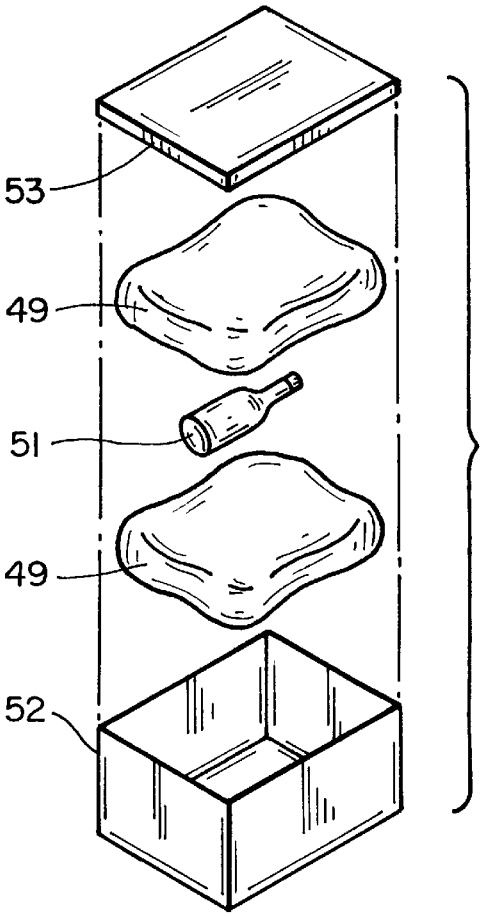
FIG. 7 is an exploded isometric view of an article packed with cushions in accordance with the invention.

In some applications it may be desirable to compress the cushions before they are placed in the carton, then allow them to expand about the article(s) to be protected. Such an application is illustrated In FIG. 7 in conjunction with the packaging of an article 51 in a carton or container 52 which has a removable lid or top 53. The article is illustrated as being in the form of a bottle, but it can be anything that needs to be protectively packaged. The container is illustrated as being a cardboard box, but it can be any container which is suitable for packaging or shipping the article. The lid can be secured to the container by any suitable means such as taping or stapling.

In this embodiment, the tubing from which the bags are formed is unvented (i.e., without vent holes 27), and after the bags are closed, air and/or other gases or fluids are withdrawn from them to reduce the pressure within them to a level below that of the surrounding environment, e.g. below atmospheric pressure. That is conveniently done by piercing each bag with a lance or needle connected to a vacuum pump. The difference in the air pressures inside and outside the bags compresses the fill material until the resilient force of the material counterbalances the compressive force applied by the pressure differential. The interiors of the cushions are thereafter repressurized to reexpand the fill material to conform to contours of the article and the interior walls of the container. The cushions can be reexpanded and used immediately after compression, or they can be sealed for storage and/or shipment in the compressed state.

If desired, recyclable, biodegradable, and/or water-soluble materials can be used either for the tubing or for the fill material, or both.

For the tubing, suitable recyclable materials include Saran, ethylene vinyl acetate (EVA), polyethylene film, paper, and the like. Suitable water-soluble materials include polyvinyl alcohol (PVOH) based materials, and hydrocarbon based alloys, such as the Enviroplastic-H based on polyoxyethylene, for example. Suitable biodegradable materials include water-soluble polyvinyl alcohol (PVOH) based films; poly-caprolactone-alphatic ester based materials; polyhydroxybutyrate-valerate (PHBV) copolymers; polyoxyethylene based materials; polyester based compostable material; starch based biopolymer materials; and other starch based materials such as those that include a catalyst to enhance photo and oxidative degradation.

For the fill material, suitable recyclable materials include extruded polystyrene (EPS) beads and other materials which are neither biodegradable nor water soluble. Suitable biodegradable materials include starch graft copolymer materials, starch biopolymer materials, wood chips and shavings, plant fibers, twigs, seeds, popcorn, and the like. Suitable water soluble materials include starch based materials and other water soluble materials. Where vented tubing is used for the bags, the particles of fill material should, of course, be larger than the vent openings to prevent spillage from the bags.

FIG. 8 illustrates an embodiment in which the tubing 23 is gathered or bunched onto a cylindrical core 56 that is mounted on a plurality of flexible fingers 57, 58 at the outlet side of dispensing valve 12. The core is fabricated of a relatively stiff material such as cardboard and has a diameter on the order of 6 to 7 inches and a length on the order of 12 to 14 inches.

Figure 9:
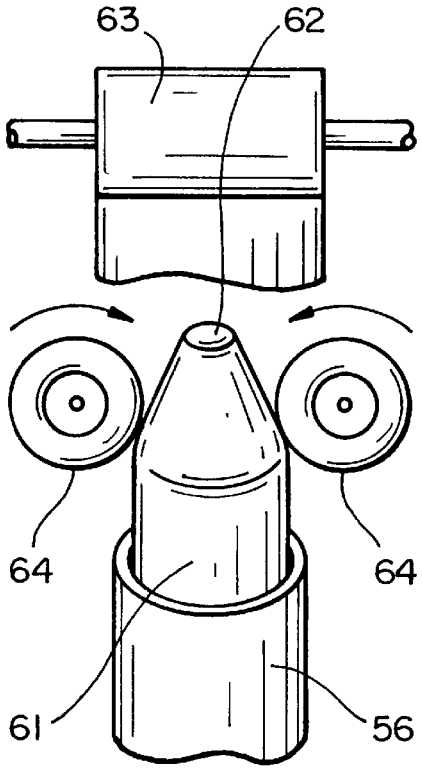
FIG. 9 is an isometric view, somewhat schematic, of a system for gathering tubing onto a cylindrical core for use in the embodiment of FIG. 8.

In one presently preferred embodiment, the tubing is gathered or bunched onto the core by means of a machine 59 which is illustrated somewhat schematically in FIG. 9. That machine has an upstanding mandrel 61 on which the core is mounted. The upper end 62 of the mandrel is tapered, and the tubing is fed onto the mandrel over the tapered end from a supply roll 63. A plurality of motorized rollers 64 at the base of the taper feed the tubing onto the core where it is gathered or bunched and secured by paper tape or ties 66. A machine of this type is available commercially from Newtec USA, Inc., Butler, Pa. (Model NS 57-A automatic sleeving machine).

Fingers 57, 58 are arranged in two pairs which are disposed in quadrature about the outlet of the valve. They are mounted on a transition piece 68 which consists of a rectangular base plate 69 with a circular opening 71, peripheral mounting flanges 72 which extend in an upward direction from the edges of the base plate, and a circular collar 73 which surrounds opening 71 and depends from the plate. Flanges 72 fit over the lower portion of valve body 13 and are secured to the valve body by mounting screws 74, with a cut-out 76 in one of the flanges providing clearance for valve actuator 14. The fingers are attached to the collar by suitable means such as rivets 77.

The fingers are formed of a resilient material such as sheet metal, and are biased toward a retracted or rest position in which they extend downwardly and inwardly from the mounting collar. As discussed more fully hereinafter, the fingers can be spread apart for engagement with the core but return to their retracted or rest position when the core is removed.

Means is provided at the lower ends of fingers 57, 58 for retaining core 56 on the fingers and the tubing 23 on the core. In the embodiment of FIG. 8, the fingers are formed from strips of sheet metal, and the lower portions of the strips are bent outwardly and upwardly to form hooks 78, 79 which retain the core and tubing.

The hooks on the two pairs of fingers are generally similar in shape and in lateral dimension, but different in vertical dimension. This enables the core to be engaged with and disengaged from the hooks in the two pairs at different times, which makes it easier for one person to install and remove the core.

Figure 10:
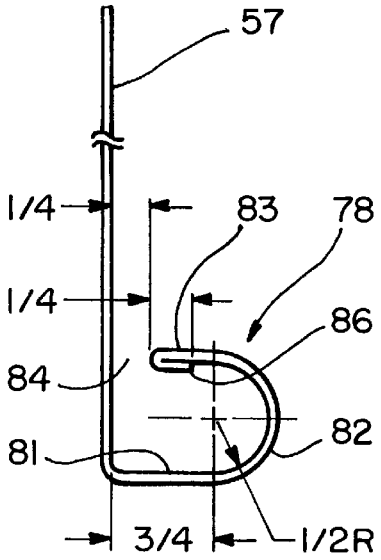
FIGS. 10 and 11 are side elevational views of the tubing holders in the embodiment of FIG. 8.
Figure 11:
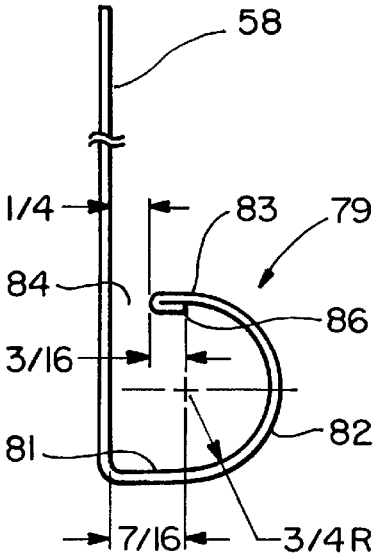
Figure 12A:
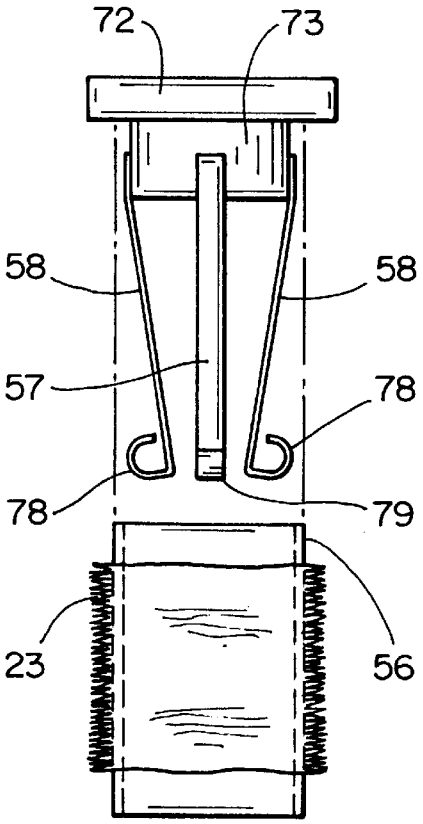
Figure 12B:
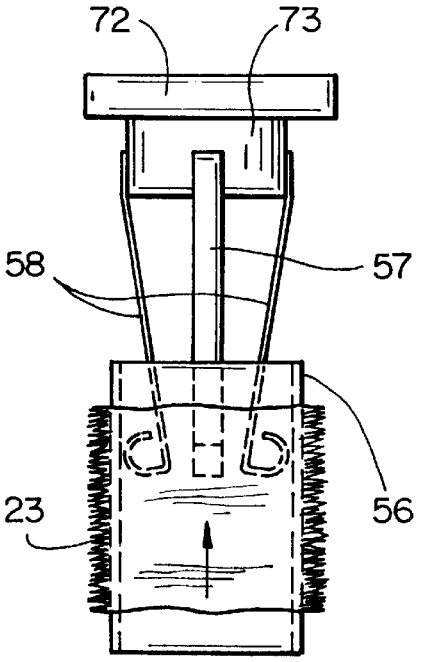
Figure 12C:
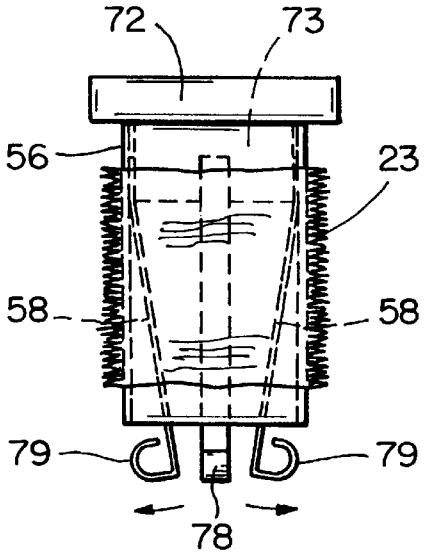
Figure 12D:
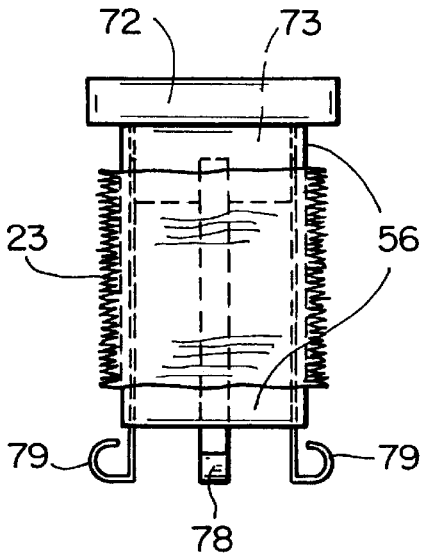
Figure 12E:
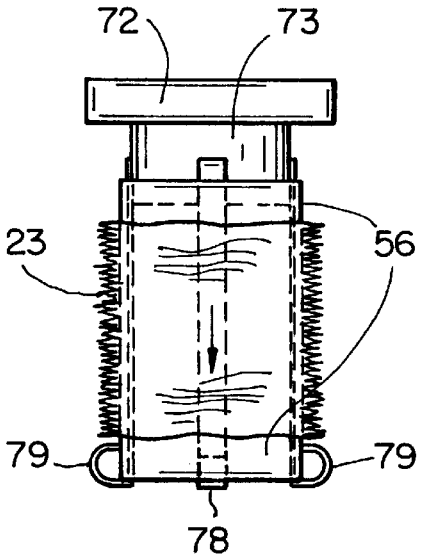
Figure 12F:
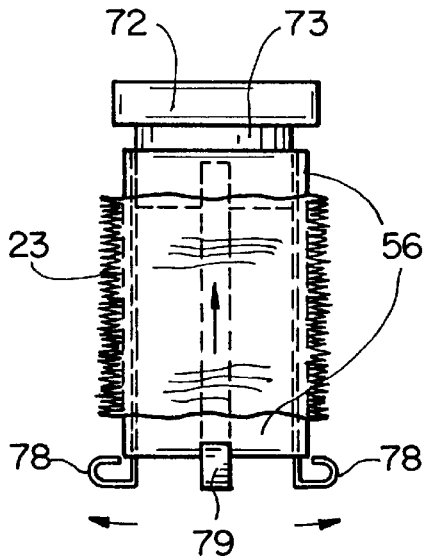
Figure 12G:
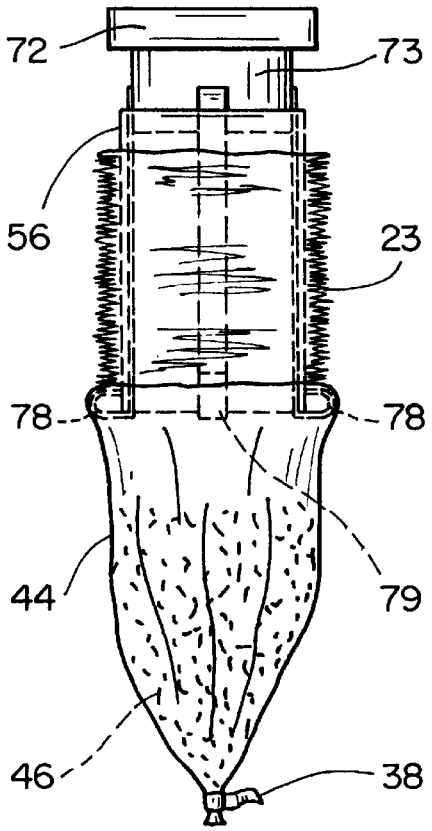

As illustrated in FIGS. 10 and 11, each of the hooks has a horizontally extending section 81 at the lowermost end of the finger, a semi-cylindrical side section 82 which extends upwardly from the outer end of lower section 81, and a horizontal section 83 which extends in an inward direction from the upper end of the side section. The upper section terminates a short distance from the finger to form an opening or gap 84 through which the lower portion of core 56 can pass. The end portion 86 of the strip is folded under to provide a smooth edge at the opening.

In one present embodiment, fingers 57, 58 are all of equal length (16⅝ inches), and hooks 79 are ½ inch taller than hooks 78. In hooks 78, lower section 81 is ¾ inch long, side section 82 has a ½ inch radius of curvature, and upper section 83 is ½ inch long. In hooks 79, lower section 81 is 7/16 inch long, side section 82 has a ¾ inch radius of curvature, and upper section 83 is 3/16 inch long. In both hooks, the gap 84 between the finger and the inner end of upper section 83 is ¼ inch. The lower sections of all four of the hooks lie in the same horizontal plane, and the lower edge of core 56 rests upon the upper surfaces of those sections.

The diameter of collar 73 is slightly less than that of the core, and when the core is mounted on the fingers and engaged with the hooks, fingers 57, 58 extend longitudinally within the core near the inner surface of the cylindrical side wall, with hooks 78, 79 projecting laterally beyond the core and the curved side sections of the hooks engaging the inside of the tubing at the lower end of the core. That engagement permits successive sections of the tubing to be pulled axially from the core while the remainder of the tubing remains in place on the core.

As illustrated in FIGS. 12*a*–12*g*, the core is installed by positioning it beneath the discharge opening of the valve and lifting it onto the fingers to a level such that the bottom edge of the core is above all four of the hooks. The lower ends of the fingers with the larger hooks, i.e. fingers 58, are then spread apart, and the core is lowered into those hooks, i.e. hooks 79. Once the core has been engaged with hooks 79, the operator can release it, and those hooks will hold it in place. To engage hooks 78, the core is raised until its lower edge clears the tops of those hooks and fingers 57 can be spread to position the openings in the hooks beneath the wall of the core. Since hooks 79 are taller than hooks 78, the lower portion of the core will remain within hooks 79 while the fingers carrying hooks 78 are being spread. The core is then lowered into the four hooks, with the lower edge of the core resting upon hook sections 81.

Once the core has been installed, the ties are removed, and successive lengths of tubing are withdrawn, filled, closed and severed to form the cushions as in the embodiment of FIG. 1. As noted above, the outer surfaces of the hooks engage the inside of the tubing passing over them, allowing successive sections of the tubing to be pulled off the core while retaining the remainder of the tubing on the core.

The core is removed by lifting it until the lower edge of the core is above the upper portions of all four hooks. With the hooks disengaged from the core, fingers retract to their rest position, and the core can drop freely over them.

FIGS. 13 and 14 illustrate embodiments similar to the embodiment of FIG. 8, with different means at the lower ends of the fingers for retaining the core on the fingers and the tubing on the core. In each of these embodiments, the lower portions of fingers 57, 58 are bent in an outward direction to form flanges 87 upon which blocks 88 are mounted to form hooks or holders for retaining the core on the fingers and the tubing on the core. The blocks are secured to the flanges by suitable means such as screws 89, with the outer portions of the blocks projecting laterally beyond the outer ends of the fingers.

In the embodiment of FIG. 13, blocks 88 consist of lengths of solid rod 91 of circular cross-section which are oriented with the axis of the rod parallel to the plane of finger on which it is mounted. These blocks have a cylindrical side wall 92, the innermost portion of which is spaced from the outer surface of the finger to form an opening 93 for receiving the lower portion of the core. The outer portion of the side wall engages the inside of the tubing and prevents the tubing from dropping off the core.

In the embodiment of FIG. 14, blocks 88 consist of lengths of solid rod 94 of semicircular cross-section which are oriented with the axis of the rod parallel to the plane of finger on which it is mounted. These blocks have a planar inner side wall 96 and a semi-cylindrical outer side wall 97, with inner wall being spaced from the outer surface of the finger to form an opening 98 for receiving the lower portion of the core. The semi-cylindrical side wall engages the inside of the tubing and prevents the tubing from falling off the core.

Operation and use of the embodiments of FIGS. 12 and 13 is similar to that of the embodiment of FIG. 8. The lower portion of core 56 passes through the opening between the block and finger, and rests upon the upper surfaces of flanges 87. If desired, the blocks can be of different vertical dimension to facilitate installation of the core as in the embodiment of FIG. 8.

If desired, the loose fill material can be dispensed directly into a carton in the embodiments of FIGS. 8–14 simply by removing the core from the fingers and placing the carton beneath the outlet of the valve.

The embodiment of FIG. 15 is generally similar to the embodiment of FIG. 8, and like reference numerals designate corresponding elements in the two embodiments. The embodiment of FIG. 15 differs from the embodiment of FIG. 8 in that it has only one pair of fingers 57 with hooks 78 for mounting core 56 to dispensing valve 12. Those fingers are disposed on diametrically opposed sides of the discharge opening in the valve.

A horizontally extending annular ring 99 is positioned over the lower portion of the core and rests upon the upper sides of hooks 78. The ring is fabricated of a relatively rigid material such as sheet metal or plastic, with an inner diameter slightly larger than the core and an outer diameter slightly smaller than tubing 23. The tubing passes over the ring, with the ring engaging the inside of the tubing to permit successive sections to be withdrawn from the core while retaining the remainder of the tubing on the core. The ring also prevents the tubing from becoming caught between the core and the hooks, as might sometimes happen without the ring.

With the ring, the hooks or retainers are not required to control the removal of tubing from the core, and the core can be mounted on the dispenser with only two hooks instead of four. With only two fingers to manipulate and two hooks to engage, it is much easier for one person to install the core on the fingers. While the ring has been described with specific reference to hooks of the type shown in FIGS. 8 and 10, it can be utilized with any other suitable types of hooks, including the ones shown in FIGS. 13 and 14.

In the embodiment of FIG. 15, means is also provided for preventing the core from being accidentally dislodged from the fingers, as might otherwise happen if the core were bumped in an upward direction or otherwise knocked out of the hooks. That means comprises a latch block 100 which is pivotally mounted on collar 73. In the embodiment illustrated, a shoulder bolt 100*a* serves as a pivot, but any other suitable type of pivot pin can be used, if desired.

The latch block is elongated, with the pivot pin positioned toward the upper end of the block so that the block normally hangs down in an extended or locking position. In that position, the lower end of the latch block serves as a limiting abutment for the upper edge of the core, which prevents the core from being lifted out of the hooks.

The latch block can be swung to a retracted position by lifting the core against the block and turning the core horizontally about its axis. As the core turns with its upper edge in contact with the block, the block pivots in an upward direction, allowing the core to move up and away from the hooks. When the core is lowered, the block drops back to its vertical position.

The tubing is installed by placing ring 99 over the lower portion of core 56 between the tubing and the end of the core, lifting the core onto fingers 57, and turning the core as it engages latch block 100 to move the block out of the blocking position. When the lower end of the core is above hooks 78, the fingers are spread apart, and the core is lowered into the hooks, with the ring resting on the upper sides of the hooks. As the core is lowered, the latch block falls back to its vertical or locking position where it prevents the core from being dislodged from the hooks. The lower portion of the tubing is drawn over the ring, and successive sections of the tubing can then be withdrawn from the core and filled with the loose fill material as in the other embodiments.

The core is removed by lifting it against the latch block and turning the core to swing the block out of the way. When the lower edge of the core clears the hooks, resilient fingers 57 return to their retracted or rest position, and the core and the ring drop freely off them, with the latch block returning to its vertical position.

FIGS. 17 and 18 illustrate an embodiment in which the tubing 23 is gathered together about a fixed mandrel, bands of tape 151 are wrapped about the gathered tubing to hold it in a bundle 152, and the bundle is then removed from the mandrel and flattened for storage and shipment. A band of strapping material 153 is wrapped longitudinally about the bundle parallel to bands 151 to hold it in its flattened or compacted state. If desired, a plurality of flattened bundles (e.g., six bundles) can be stacked together and secured with a single strap.

The compression of the bundles results in a significant saving of space and eliminates the need to provide and dispose of a separate core for each bundle. In that regard, for example, a 400 foot length of tubing which is gathered onto a core which is seven inches in diameter and 15 inches long typically has an outside diameter on the order of 11 inches, and requires a volume of approximately 1425 cubic inches. When flattened, that same bundle occupies a space approximately 13 inches long, 12 inches wide and 4 inches high, with a volume of approximately 625 cubic inches.

Bands 151 are reatively wide so that they will remain in place when the bundle is flattened. In the embodiment illustrated, four bands are employed, and they are spaced in quadrature about the bundle. For a bundle formed on a seven inch mandrel, each band has a width on the order of three inches. These bands are formed of a material such as paper or plastic tape with reinforcing filaments, and the ends of the bands are secured together by suitable means such as staples or and an adhesive.

FIGS. 19 and 20 illustrate a collapsible core 156 which can be utilized to mount bundles 152 on the dispenser. Core 156 has a cylindrical side wall 157 which is formed in three sections 158–160 that are disposed side-by-side and hinged together along longitudinally extending lines 162–164 between the sections. In this particular embodiment, the wall sections are fabricated of sheet metal, plastic or another suitable semi-rigid material, and they are connected together by hinges 166–168. Wall section 158 has an arc length on the order of 270° to 300° and sections 159, 160 each have an arc length on the order of 30° to 45°.

In its normal state, shown in solid lines in FIG. 20, the core is in the form of a right circular cylinder which has a diameter corresponding to that of the core or mandrel on which bundles 152 are formed. In the collapsed state, which is shown in dashed lines in FIG. 20, wall sections 159, 160 extend in an inward direction, and the diameter of the cylinder is reduced. Since the spacing between the edges of wall section 158 is less than the combined chord lengths of wall sections 159, 160, section 158 must flex and its edges must separate somewhat as sections 159, 160 are swung between their extended and collapsed positions. The material which forms section 158 has a memory which causes that section to lend to return to its normal shape. The wall sections thus function as an over-center mechanism, with the force produced by the memory of section 158 biasing the two shorter sections toward their extended and collapsed positions.

In operation, core 156 is collapsed by pressing inwardly on wall sections 159, 160. The collapsed core is then inserted into a bundle of tubing from which the band 153 has been removed and expanded by pressing outwardly on sections 159, 160. Once the tubing is on the core, bands 151 are removed, and the core is mounted on the loose fill dispenser in the same manner that core 56 is mounted in the embodiments discussed above, e.g. by mounting it on fingers 57 in the embodiment shown in FIG. 15. In that particular embodiment, ring 99 is placed over the lower portion of the core, and the tubing passes over the ring as it is withdrawn from the core, with latch block 100 preventing the core from being inadvertently lifted and dislodged from the hooks at the lower ends of the fingers.

FIG. 21 illustrates an embodiment in which a collapsible core 171 is fabricated of a material such as cardboard or plastic, with wall sections 172–174 corresponding to the wall sections 158–160 of FIG. 19. In this embodiment, the hinges between the wall sections are formed by longitudinally extending score lines 176–178, with lines 176, 178 being on the outside of the cylinder and line 177 being on the inside. This core functions in the same manner as core 156, with wall sections 173, 174 swinging between the extended position shown in solid lines and the collapsed position shown in dashed lines.

In the embodiment of FIG. 22, a collapsible core 181 consists of a cylinder 182 having a side wall 183 fabricated of a somewhat flexible plastic material such as polypropylene having a thickness on the order of 0.020 to 0.030 inch. This core has no hinges, and is collapsed by caving in the side wall on one side of the cylinder as illustrated in FIG. 23. On the collapsed side, the curvature of the side wall is reversed to form an inwardly directed lobe 184 between a pair of outwardly directed lobes 186. The curvature on the side 187 opposite the collapsed side is reduced, and the cylinder has a smaller overall diameter in the collapsed state than in the uncollapsed or expanded state. When the collapsed cylinder is released, it returns to its original or expanded shape.

Operation and use of the collapsible core of FIG. 22 is similar to that of the other embodiments except for the manner in which the core is collapsed.

FIG. 24 illustrates a collapsible core assembly 189 which includes a collapsible cylinder 191 with a ring 192 attached to the lower portion of the cylinder. The cylinder is fabricated of a flexible plastic material such as polypropylene and is similar to core 181 in the embodiment of FIG. 22. The ring has a generally U-shaped cross-section with an annular top wall 193 and a pair of depending flanges 194, 196. It is fabricated of a rigid material and can, for example, be formed of plastic by vacuum forming or injection molding.

The cylinder is disposed within the ring and is attached to inner flange 194 by rivets 197 over about 60° of its circumference. The remainder of the cylinder is free to collapse and expand within the ring. A pair of pins 198 project outwardly in a radial direction from the cylinder and are received in openings 199 in the inner flange of the ring when the cylinder is expanded. The pins are spaced about 60° apart and are positioned opposite the rivets.

As illustrated in FIG. 26, core assembly 189 is mounted on the outlet side of dispensing valve 12 by means of a pair of retractable latches or hooks 201 on the cylindrical collar 73 of transition piece 68. The latches have a horizontally extending upper surface 202 and a downwardly and inwardly inclined side surface 203, and they are movable between the extended position shown in solid lines in FIG. 26 and the retracted position shown in broken lines. The latches are urged toward the extended position by springs (not shown).

Latches 201 are received in openings 206 in the upper portion of cylinder 191. Even though there are only two latches, the openings are spaced about the entire periphery of the cylinder so the operator does not have to worry about the orientation of the cylinder while mounting it on the dispenser.

In operation, core assembly 189 is removed from the dispenser, and cylinder 191 is collapsed and inserted into a bundle of tubing 152. The cylinder is then expanded and mounted on the dispenser. As the cylinder is moved in an upward direction onto collar 73, it engages the inclined side surfaces 203 of the latches and depresses them. When two of the openings 206 in the cylinder are aligned with the latches, the latches snap to their extended position and thereafter hold the cylinder on the dispenser.

The lower portion of the tubing 23 is drawn over the ring, and successive sections of the tubing can then be withdrawn from the core and filled with the loose fill material as in the other embodiments.

The core assembly is removed from the dispenser by manually depressing latches 201 to disengage them from the openings in the core cylinder whereupon the core will drop and can be moved away from the dispenser.

The core assembly of FIG. 24 can also be mounted on the dispenser by other means such as the fingers and hooks of FIG. 15 and some of the other embodiments. However, without fingers passing through the core the length of the core is not limited by the length of the fingers, and longer cores with more tubing can be employed.

FIG. 27 illustrates a collapsible core assembly 208 which has a collapsible cylinder 209 with a flexible ring 211 attached to the lower portion of the cylinder. The cylinder is fabricated of a flexible plastic material such as polypropylene and is similar to core 191 in the embodiment of FIG. 24. The ring is fabricated of a flexible material and is secured all the way around the cylinder.

In the embodiment illustrated, ring 211 has a generally circular cross-section, and it can is fabricated of a tubular plastic material. However, the ring can be fabricated of any material which will flex with the cylinder, and it can be solid or hollow.

Openings 212 are formed in the upper portion of the cylinder for mounting the core on the dispenser, as in the embodiment of FIG. 24.

Operation and use of core assembly 208 is similar to that of core assembly 189 except that ring 211 flexes with cylinder 209 as it is collapsed and expanded.

Core assembly 208 can also be mounted by other means such as the fingers and hooks of FIG. 15 and some of the other embodiments. With those hooks, ring 211 can be spaced a short distance above the lower edge of the cylinder to provide clearance for the hooks.

The invention has a number of important features and advantages. It enables packing cushions to be manufactured at the point of use quickly and economically without the spillage and mess normally associated with loose fill materials. It also eliminates the problems of messiness and spillage at the receiving end when the cartons are opened and the articles packed therein are removed. Being contained in the cushions, the loose fill material will not tend to cling to the articles packed in it or to the hands and arms of a person removing the articles from it. The cushions also prevent the packaged goods from contact with materials such as starch which tend to absorb water and become soggy during humid conditions. The cushions can be molded to the shape of the articles to be protected, and tend to provide better protection than a loose body of material. If desired, advertising and/or other messages can be printed on the bags.

It is apparent from the foregoing that a new and improved system and method for bagging loose fill packing materials has been provided. While only certain presently preferred embodiments have been described in detail, as will be apparent to those familiar with the art, certain changes and modifications can be made without departing from the scope of the invention as defined by the following claims.

We claim:

1. A system for packaging loose fill packing material in bags for use as cushions in shipping cartons, comprising:

a dispenser having an outlet through which loose fill packing material is discharged;

an elongated length of flexible plastic tubing gathered axially together for use as bags for holding the loose fill material;

a laterally collapsible core which can be inserted into the tubing in a collapsed condition and expanded to form an internal support for the tubing;

a plurality of fingers which extend from the outlet and pass through the core for mounting the core in proximity to the outlet so that successive sections of the tubing can be drawn from the core and into communication with the outlet for receiving loose fill material discharged through the outlet; and hooks toward the outer ends of the fingers for retaining the core on the fingers.

2. The system of claim 1 wherein the collapsible core comprises a cylinder having a side wall of circular cross-section fabricated of a flexible plastic material which is collapsed by caving in the wall on one side of the cylinder to form an inwardly directed lobe.

3. The system of claim 2 wherein the cylinder is fabricated of polypropylene.

4. The system of claim 2 including a laterally projecting ring mounted over the lower portion of the cylinder and attached to the side wall along only a portion of the wall opposite the one side for interiorly engaging with the tubing to retain the tubing on the core while permitting the successive sections to be withdrawn.

5. The system of claim 2 including means engagable between the one side of the cylinder and the ring to provide a supporting connection between the one side and the ring when the cylinder is expanded.

6. The system of claim 1 wherein the collapsible core comprises a cylinder having a side wall of circular cross-section fabricated of a flexible plastic material which is collapsed by caving in the wall on one side of the cylinder to form an inwardly directed lobe and a flexible laterally projecting ring which collapses with the cylinder attached to a lower portion of the side wall for interior engagement with the tubing to retain the tubing on the core while permitting the successive sections to be withdrawn.

7. The system of claim 1 wherein the collapsible core has a cylindrical side wall with a plurality of longitudinally extending sections which are disposed side-by-side and hingedly connected together along longitudinally extending lines.

8. The system of claim 7 wherein the side wall has three sections, one of which has an arc length on the order of 270° to 300°, and the other two of which have arc lengths on the order of 30° to 45°.

9. The system of claim 1 including a laterally projecting ring which fits over the core near the hooks and interiorly engages the tubing to retain the tubing on the core while permitting the successive sections to be withdrawn.

10. The system of claim 1 including means engageable with the core for limiting movement of the core to prevent the core from being dislodged from the hooks.

11. The system of claim 10 wherein the means for limiting movement of the core comprises a latch which is pivotally mounted to the dispenser for movement to a retracted position in which the core can move far enough to clear the hooks as the core is mounted on and/or removed from the fingers.

12. The system of claim 1 including a plurality of bands wrapped longitudinally about the gathered tubing to hold the tubing together in a bundle before the core is inserted.

13. The system of claim 12 wherein the bundle is flattened for shipment and/or storage.

14. In a method of packaging loose fill packing material in bags for use as cushions in shipping cartons, the steps of:

gathering an elongated length of flexible plastic tubing together axially to form a bundle;

inserting a laterally collapsed core into the bundle and expanding the core to support the tubing; and mounting the core in proximity to an outlet through which loose fill packing material is dispensed by passing the core over resilient fingers which extend from the outlet and engaging the hooks at the outer ends of the fingers with one end of the core to retain the core on the fingers.

15. The method of claim 14 further including the step of wrapping bands longitudinally about the gathered tubing to hold the bundle together before the core is inserted.

16. The method of claim 14 wherein the bundle is flattened for shipment and/or storage.

17. The method of claim 14 including the step of drawing the sections of tubing over a ring which projects laterally from the core and interiorly engages the tubing to permit the successive sections to be drawn from the core while retaining the remainder of the tubing on the core

.

18. The method of claim 14 wherein the core is passed over the fingers until the one end has moved past the hooks, and the hooks are engaged by extending them laterally beyond the core and then moving the core back along the fingers into the hooks.

19. The method of claim 18 including the step of setting a latch for engagement with a second end of the core to limit movement of the core on the fingers after the hooks have been engaged.

20. The method of claim 14 wherein the core comprises a flexible plastic cylinder having a side wall of circular cross-section, and the cylinder is collapsed by caving in the wall on one side of the cylinder to form an inwardly directed lobe.

* * * * *